US010527349B2

(12) United States Patent
Palsson

(10) Patent No.: US 10,527,349 B2
(45) Date of Patent: Jan. 7, 2020

(54) APPARATUS FOR COOKING AND DRYING ORGANIC MATERIAL

(71) Applicant: HEDINN HF, Hafnarfjordur (IS)

(72) Inventor: Gunnar Palsson, Reykjavík (IS)

(73) Assignee: HEDINN HF, Hafnarfjordur (IS)

( * ) Notice: Subject to any disclaimer, the term of this patent is extended or adjusted under 35 U.S.C. 154(b) by 615 days.

(21) Appl. No.: 15/317,586

(22) PCT Filed: Jun. 10, 2015

(86) PCT No.: PCT/IS2015/050011
§ 371 (c)(1),
(2) Date: Dec. 9, 2016

(87) PCT Pub. No.: WO2015/189864
PCT Pub. Date: Dec. 17, 2015

(65) Prior Publication Data

US 2017/0115056 A1 Apr. 27, 2017

(30) Foreign Application Priority Data

Jun. 12, 2014 (IS) ..... 050084

(51) Int. Cl.
*F26B 11/12* (2006.01)
*F26B 3/24* (2006.01)
*F26B 25/04* (2006.01)

(52) U.S. Cl.
CPC ..... *F26B 3/24* (2013.01); *F26B 25/04* (2013.01)

(58) Field of Classification Search
CPC ..... F26B 33/24; F26B 25/04; F26B 17/20; F26B 17/28; A22C 5/00; B01F 7/04; B01F 7/025; B01F 15/00662; B01F 3/1221; B01F 7/048; B01F 7/00158; B01F 7/00208; F28D 7/106; F28D 2021/0042; F28D 15/00; F28D 15/02; F28D 15/0266; F28D 2021/0098; F28D 5/00; F28D 7/024; F28D 7/12; F28D 7/16; F28D 7/1646; F28D 7/1676
See application file for complete search history.

(56) References Cited

U.S. PATENT DOCUMENTS 3,687,422 A 8/1972 List
4,058,907 A 11/1977 Lipp et al.
(Continued)

FOREIGN PATENT DOCUMENTS

CN 2039402 U 6/1989
CN 2139846 Y 8/1993
(Continued)

OTHER PUBLICATIONS

Icelandic Search Report for corresponding Icelandic Application No. 050084, dated Oct. 9, 2014.
(Continued)

*Primary Examiner* — Jason Lau
(74) *Attorney, Agent, or Firm* — Workman Nydegger

(57) ABSTRACT

The present invention relates to a new device and a way to assemble such a device for both cooking and drying organic material in the process of making meal. The device of the present invention has a large area for heat exchange and scrapers which stir the material in the container rather than transferring it around in circles. The method of assembling the device allows an accurate and convenient assembly so that the scrapers thoroughly scrape all inner surfaces of the device.

16 Claims, 3 Drawing Sheets

(56) References Cited

U.S. PATENT DOCUMENTS

| | | | |
|---|---|---|---|
| 4,276,701 | A | 7/1981 | Takacs et al. |
| 4,344,976 | A | 8/1982 | Bladh |
| 4,353,413 | A | 10/1982 | Allen et al. |
| 5,934,801 | A | 8/1999 | List et al. |
| 5,957,041 | A | 9/1999 | Fosbol et al. |

FOREIGN PATENT DOCUMENTS

| | | | |
|---|---|---|---|
| CN | 2147485 | Y | 11/1993 |
| CN | 2154447 | Y | 1/1994 |
| CN | 2270952 | Y | 12/1997 |
| CN | 2366807 | Y | 3/2000 |
| CN | 2374826 | Y | 4/2000 |
| DE | 1136890 | B | 9/1962 |
| EP | 1553368 | A1 | 7/2005 |
| FR | 2712076 | A1 | 5/1995 |
| GB | 2324141 | A1 | 10/1998 |

OTHER PUBLICATIONS

International Search Report for corresponding International PCT Application No. PCT/IS2015/050011, dated Oct. 16, 2015.

APPARATUS FOR COOKING AND DRYING ORGANIC MATERIAL

FIELD

The present invention relates to a new device and a way to assemble such a device for both cooking and drying organic material in the process of making meal.

INTRODUCTION

Preparation of meal from raw organic material, including separating fish oil from the material and evaporating the water phase therefrom is well a known method. It involves hashing or hacking fish or meat/animal parts and cooking this organic material in one or more cookers. The cookers are usually screw cookers, where the organic material is slowly transported along the cooker while it is being warmed up and cooked. After the oil phase has been separated from the material, the water is removed by heat and evaporation.

Production of high quality low-heat generated fish meal requires a process where the material is not overheated, especially when the oil phase has been removed and water is evaporating. It also requires that the material does not stick to the surfaces of various components of the devices used and overheats or burns thereon. In the early stages, where the water content is above 40%, the temperature of the material can be at 100° C. as it passes through the cookers. When the oil phase and part of the water has been removed, the rest of the process is performed at low temperature to preserve the proteins.

Prior art cookers normally comprise either of a steam cooker of screw type, a Contherm-type or a tubular heater. A steam cooker is generally designed as a cylinder having a steam heated jacket throughout and a steam heated rotor, designed as a screw conveyor with hollow flights. Material sticking to heat exchange surfaces makes control of cooking problematic. A Contherm heater consists of a vertical cylindrical heat exchanger provided with an agitator keeping the material in rapid movement, thus contributing to effective heat transfer. During rotation, the agitator blades (knives) are pressed against the surrounding heating surface in order to prevent the formation of material on the surface. These devices need to be cleaned very frequently, which is time consuming and prevents continuous use.

A tubular heater consists of a set of tubes coupled together and surrounded by a cylindrical jacket. The raw material is moved through the tubes by pumping, and on its way it is heated by the hot steam or condense water circulating around the tubes. These are most often only used as pre-cooker to utilize waste energy to partially heat the material up to 50° C.

All these cookers have rather poor material mixing and material formation on heating surfaces which limits heat exchange. Prior art dryers normally comprise either of direct heat drying or indirect steam drying.

The direct rotary dryer blows a current of flue gases diluted with secondary air, in direct contact with the fish material being dried. This method is efficient but can be a source of contamination of the product. One of the problems with rotary dryers is that there will be a collection of gas in the upperpart of each disc requiring a certain step of emptying the gas from the row of discs, which is difficult to regulate.

In the indirect steam dryer the material is fed continuously into one end and is dried in direct contact with steam heated elements. Most common the elements are a steam heated rotor equipped with steam heated double walled discs perpendicular to the rotor. The problems with such device are insufficient scraping to prevent material build-up on the heating surface and material can burn thereon. Furthermore, it tends to be structurally heavy and expensive with a high resistance to rotation necessary for this application.

U.S. Pat. No. 4,344,976 discloses a typical process for recovery of meal from fish, where heating of the fish mass is carried out in any conventional way, and oil is separated from the heated fish mass by means of a centrifuge provided with a separate outlet for separated oil phase. In this publication the stick water and sludge are discharged from the centrifuge are fed together to an evaporation unit where the mixture of sludge and stick water is fed through one or several indirectly heated tubes. The internal walls of which are continuously cleaned by means of a scraping device and the outlet of which is connected to a separation space for steam and evaporated product.

FR2712076 discloses a dryer for wet products comprising a row of parallel hollow circular discs spaced along the length of a chamber. The discs are fixed to the walls of the chamber and a heat-exchange fluid flows through these discs during the drying process. Plates, which are fixed to a rotating shaft containing scrapers for scraping the surfaces of the discs are arranged between the discs.

SUMMARY

Production of high quality low-heat generated meal from organic material requires processes where the organic material is first cooked and then the water phase is removed by an evaporation process. The present invention provides a new device and a way to assemble such a device for both cooking and drying organic material in the process of making meal.

The present invention provides a device and a method to overcome or ameliorate the aforementioned drawbacks of the prior art and to provide an improved and/or alternative and/or additional method or device for heating or removing a water phase from organic material. The present invention provides a device with a simple and robust design where a large area for heat exchange and instead of moving the material in circles during rotation of the axis, the material is stirred with scrapes that scrape both the discs and the inner surface of the container. The present invention provides a faster process of cooking and drying and it prevents the material from burning on the surfaces of the device during the process. The heat exchange surface is therefore more efficient and the device easier to control. The present invention provides a device and a method to produce meal of higher quality as it supports a process, where the organic material does not overheat during the drying process and does not stick to the surfaces of the device and burns. The present invention provides a device and a method where do to the fact that the discs do not connect to the whole circumference of the cylindrical portion of the container, in addition to the space above the discs, the organic material can travel easily from one space to another from the in-feed end to the out-feed end of the container.

The present invention provides a new design which also provides a new way to assemble such a device, where each disc is placed in a container, where the lower portion of the container is of cylindrical shape. The bottom portion of the container as a cylindrical shape, whereas the upper portion is open at the top during assembly. The discs are positioned in a parallel manner with spaces between them. In order to solve problems of gas "collection" in the upper part of the disc, the discs of the present invention are semi-cylindrical disc-shaped hollow compartments with a relatively flat upper part. The discs have one or more hollow connection members and connect to openings in the container for circulating heating media through the discs from a jacked arranged around the container. As the inlets into the semi-cylindrical disc-shaped hollow compartments are positioned in the upper part of the disc in line with the relatively flat upper part of the disc, no collection or compilation of gases will reside in the upper portion of the discs. Furthermore, as condense will drip out of an outlet hollow connection in the lower portion of the semi-cylindrical disc-shaped hollow compartments, this will generate a suction effect and facilitate a flow of condense to and from the jacket and through the semi-cylindrical disc-shaped hollow compartments. As the discs have one or more hollow connection members and connect to openings in the container, the discs can be adjusted and welded in a precise and correct position from the outside of the container. During the assembly the scrapes, which are attached to the axis, can be adjusted to scrape both discs in the space they are mounted in as well as the inner surface of the container. The scrapes can also be tilted to direct the material in a slightly backward or forward direction depending on the drying stage of the material. After assembly, the container can be closed from the top. Each disc is assembled together from two disc components where grooves have been milled from one connection member of the disc to another in a pattern which allows the heating media to flow and heat the whole outer surface of the disc. The two disc components are bolted together, rather than welded, to get a more accurate form of the disc. The disc is in fact a pressure chamber or cartridge, which can conduct any heating media, such as, but not limited to steam, oil, water etc. It is the combination of a) the shape of the semi-cylindrical disc-shaped hollow compartments, b) the position of the one or more hollow connection members connecting the disc to the openings in the container and c) the use of vertical recesses leading to the connection openings in the side of the container, which provides the improved device and the assembly method resulting in more accurate and easy assembly of the device and which provides a device which makes better use of the entire surface of the discs in the dryer. Due to the shape of the semi-cylindrical disc-shaped hollow compartments and the position of the one or more hollow connection members connecting the disc to the openings in the container a constant flow of heating media through the entire disc is enabled and compilation of gases in the top part of the discs.

The object(s) underlying the present invention is (are) particularly solved by the features defined in the independent claims. The dependent claims relate to preferred embodiments of the present invention. Further additional and/or alternative embodiments are discussed below.

The present invention provides an apparatus for heating or removing a water phase from organic material. The apparatus comprises a container, said container being substantially horizontal and where the lower portion of the container has a cylindrical shape, said container further comprising an inlet and an outlet. The apparatus further comprises a plurality of semi-cylindrical disc-shaped hollow compartments parallel and interspace arranged in the container and a jacket arranged around the container for conducting heating media. An axis arranged centrally within the container and scrapes are attached to, and rotating on the centrally arranged axis, where the scrapes are shaped to scrape an outer surface of two parallel and interspace arranged disc-shaped hollow compartments and extending towards and to scrape the inner surface of the container. Furthermore, the semi-cylindrical disc-shaped hollow compartments comprise hollow protrusions, which connect to the jacket through connection openings in the container. The protrusions are positioned on each side in the upper part and in the lowest part of the semi-cylindrical disc-shaped hollow compartments.

In the present context the term "substantially" in a substantially horizontal container refers to a container which is arranged in a horizontal position, but may be slightly tilted or raised at the in-feed end to facilitate a movement of the organic material towards the out-feed end.

The present invention also provides a method is provided for assembling an apparatus for heating or removing a water phase from organic material. The method comprises

- providing a container, where the container is substantially horizontal. The container further comprises an inlet and an outlet,
- arranging a plurality of disc-shaped hollow compartments parallel and interspaced in the container,
- arranging a jacket arranged around the container and connecting to the said disc-shaped hollow compartments to the jacked through openings in the container,
- arranging an axis centrally within the container, and
- providing scrapes attached to the axis and rotating on the axis, where the scrapes are shaped to scrape an outer surface of two parallel and interspace arranged disc-shaped hollow compartments and extending towards and to scrape the inner surface of the container.

Furthermore, the method comprises connecting the semi-cylindrical disc-shaped hollow compartments comprise hollow protrusions to the jacket through connection openings in the container, where the protrusions are positioned on each side in the upper part and in the lowest part of the semi-cylindrical disc-shaped hollow compartments.

In the present context the terms "semi-cylindrical disc-shaped hollow compartments" and discs refers to the same item, namely the discs that are inserted into the container. The discs are not fully cylindrical as they contain connection members to connect to the jacket.

In the present context, the bottom portion of the container is cylindrical so that the scrapes, which are arranged on the rotating axis, can scrape the inner side of the container as well as the discs. The upper portion may have any shape such as, but not limited to oval, cylindrical, square (as shown in the drawings) etc. as long as it does allow room the scrapes to rotate a whole circle around the axis.

All embodiments and definitions relate to the apparatus and the method of the invention.

In the present context the apparatus and method relate to a device for the production of fish-meal or meat-meal or other organic material, where the device can either be used as a cooker or a dryer/evaporator.

In an embodiment of the present invention, the scrapes extend fully to the inner surface of the container. Furthermore, the arm of each scrape has a spring element to push the scrape closer to the inner surface of the container when possible.

In an embodiment of the present invention, the scrapes are not arranged in parallel on the axis, but have different position on the axis with respect to the discs. Therefore, some scrapes may be scraping the lower part of the chamber whereas other scrapes may be rotating above the disc upper portion of the semi-cylindrical disc.

In an embodiment of the present invention, the scrapes have 3 different scraping members, two disc scrape members to scrape the discs on each side and one end scrape member to scrape inner surface of the container. Furthermore the scrapes have hollow space between the different scraping members.

In an embodiment of the present invention, the container is raised at the in-feed end above the out-feed end of the container. This is to facilitate the material to slowly migrate from the in-feed end towards the out-feed end of the container.

In an embodiment of the present invention, the blade of the scrapes is shaped to direct the organic material over to the next space between two parallel and interspace arranged disc-shaped hollow compartments, from the in-feed end and towards the out-feed end of the container.

In an embodiment of the present invention, the inner surface of the container comprises vertical recesses leading to the connection openings in the side of the container.

In an embodiment of the present invention, the disc-shaped hollow compartments have a semi-cylindrical shape and further comprise connection openings to connect to the jacket through the wall of the container.

In an embodiment of the present invention, the jacket is a compartment for conducting heating media.

In an embodiment of the present invention, the heating media within the jacket is a steam.

In an embodiment of the present invention, the apparatus is a cooker or a dryer.

In an embodiment of the present invention, each semi-cylindrical disc-shaped hollow compartment is attached to the openings in the container from the outside. The attachment of the disc to the opening can be done by any mechanical means, but preferably by welding.

In an embodiment of the present invention, the jacked is arranged around the container after the semi-cylindrical disc-shaped hollow compartments have been attached to the container.

In an embodiment of the present invention an opening at the top of the container is closed after the semi-cylindrical disc-shaped hollow compartments, the axis and the scrapes have been arranged within the container and the semi-cylindrical disc-shaped hollow compartments have been attached to the container.

In an embodiment of the present invention, the device is a dryer further comprising an air inlet for receiving dry air. The dry air is blown into the dryer, where it blends with the material during an evaporation process of the water phase from organic material. The dryer also comprises an air outlet for directing saturated air out of the dryer. In this embodiment the material enters the dryer as a slurry paste. The scrapers are used to rotate the paste to interact with the air-phase therein as well as the thermal surfaces of the discs and of the inner surface of the container. The slurry paste material may as warm as 100° C. as it enters the dryer, but as the paste reacts with the air phase and the hot surfaces of the cylinder and the discs, the heat leaves the paste with the water molecules.

DESCRIPTION OF VARIOUS EMBODIMENTS

Figure 1:
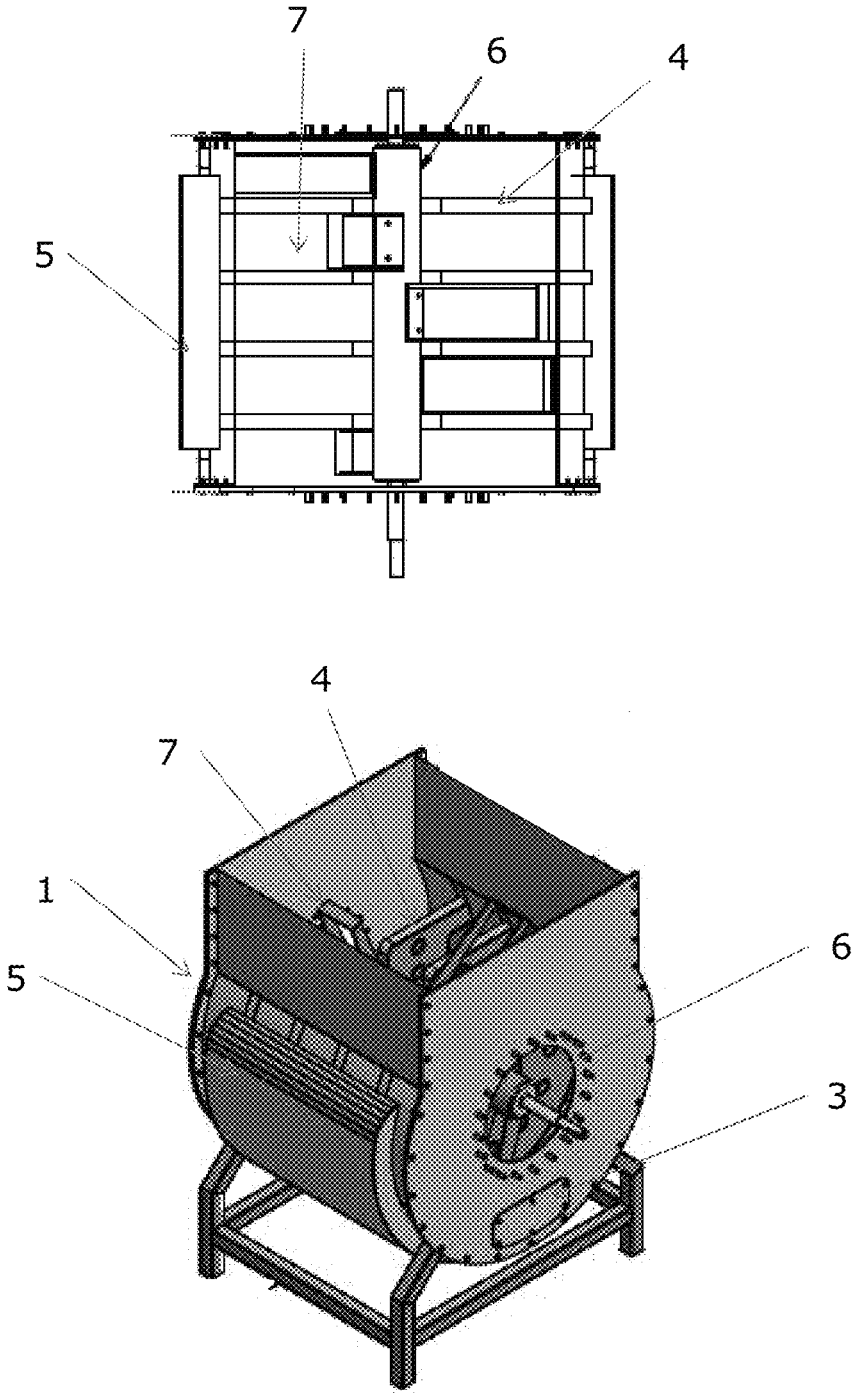
FIG. 1 schematically shows the top and perspective views of a device for heating and/or drying organic material.

In the following, exemplary embodiments of the invention will be described, referring to the figures. The embodiments shown in the drawings are explained with reference numbers. These examples are provided to provide further understanding of the invention, without limiting its scope. The skilled person will understand that the drawings, described below, are for illustration purposes only. The drawings are not intended to limit the scope of the present teachings in any way.

In the following description, a series of steps are described. The skilled person will appreciate that unless required by the context, the order of steps is not critical for the resulting configuration and its effect. Further, it will be apparent to the skilled person that irrespective of the order of steps, the presence or absence of time delay between steps, can be present between some or all of the described steps.

Referring to FIG. 1 there is schematically shown a top view (A) and a perspective view (B) of the device of the present invention for heating and/or drying organic material, such as in the process of generating meal from organic material from fish or meat. The device shown in FIG. 1 comprises a semi-cylindrical container 1, where the upper part of the cylindrical shaped container has a rectangular shaped compartment (open at the top in this drawing to show the discs and the scrapes). The container has an inlet 2 (not shown) and an outlet 3 on each end. The semi-cylindrical container 1 comprises a plurality of semi-cylindrical disc-shaped hollow compartments 4 arranged in a parallel and interspaced manner within the container. A jacket 5 is arranged around the cylindrical portion of the container 1 for conducting heating medium around the container for heating up the surface of the container. A rotating axis 6 is arranged centrally within the semi-cylindrical container 1 for mounting scrapes 7 onto. The rotating axis 6, moves the scrapes 7, which are shaped to scrape the outer surface of two parallel and interspace arranged semi-cylindrical discs and the outer surface of the container.

Figure 2A:
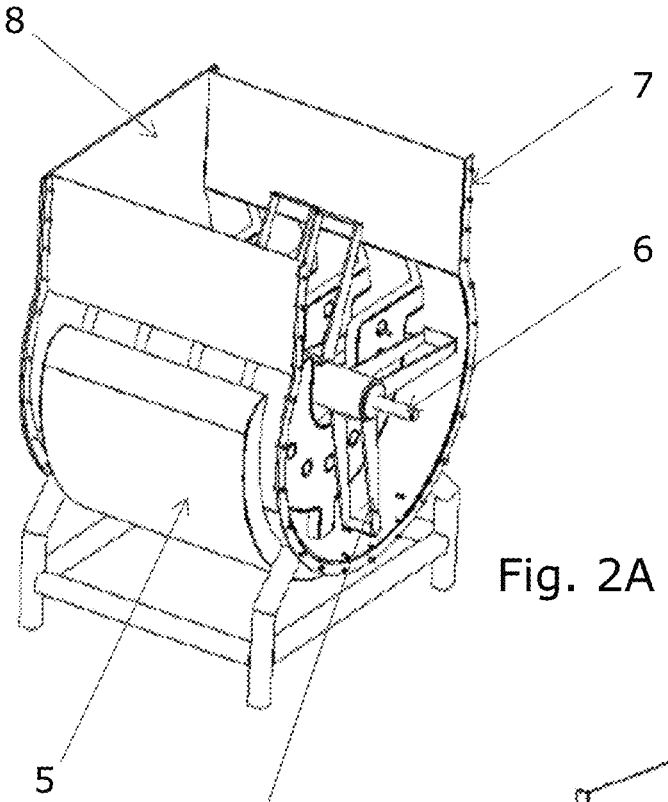
FIG. 2A is a perspective view showing the discs and scrapes in a first angle.
Figure 2B:
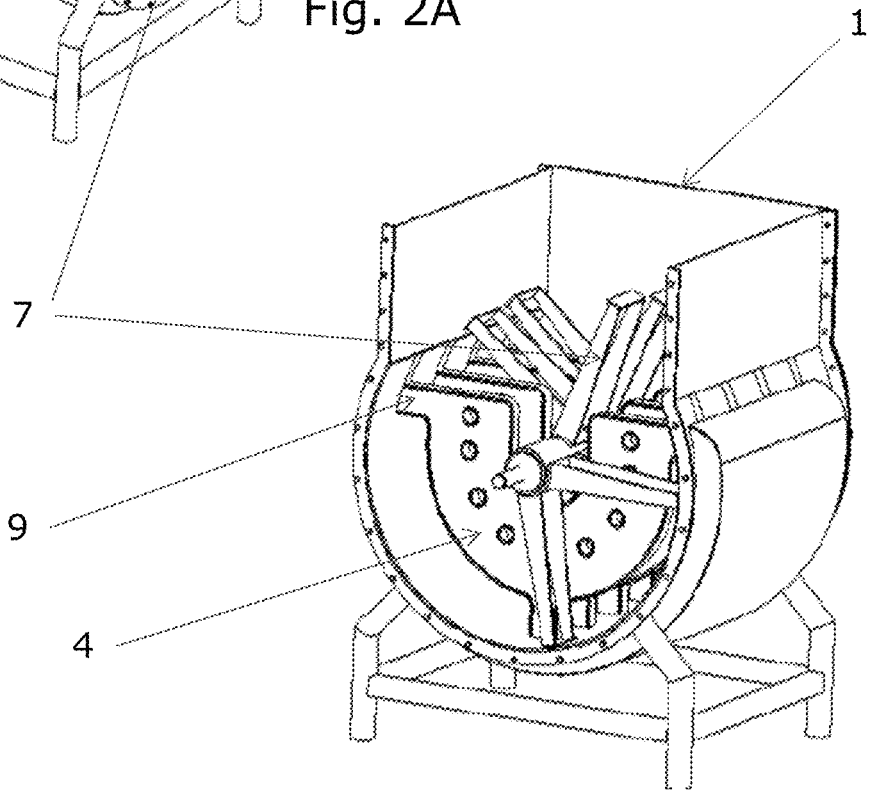
FIG. 2B is a perspective view showing the discs and scrapes in a second angle.
Figure 3:
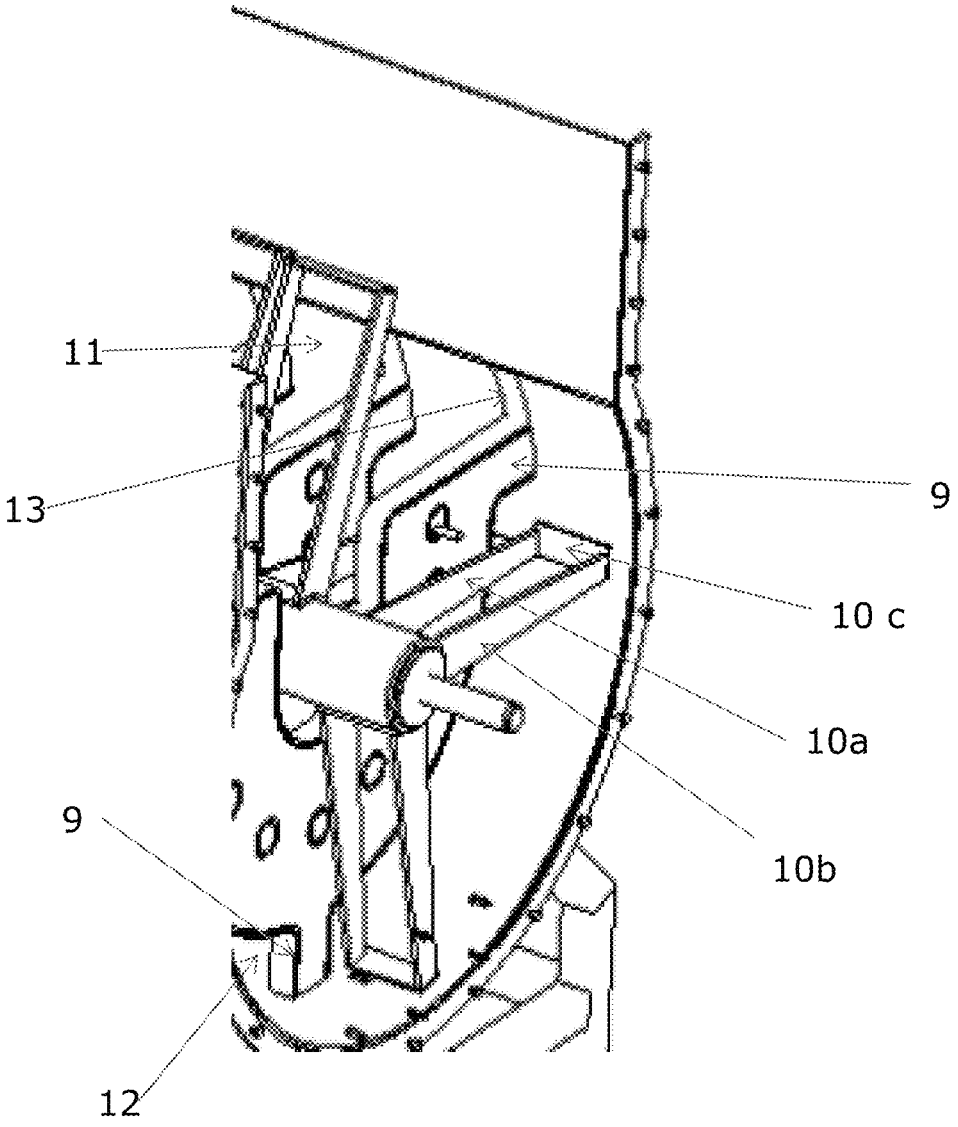
FIG. 3 is an enlarged portions view of FIG. 2A.

In FIG. 2 the arrangement of the discs and the scrapes within the device of the present invention is shown from two different angles (A and B). The disc-shaped hollow compartments 5 are shown arranged side by side, where a connection portion on each side of the upper side of the dish sits in a recess on each side of the inner side of the container 1. Upon assembly, the upper side of the container is open 8 and therefore the various components of the device, such as discs, axis and scrapes can be arranged and adjusted within the container before it is closed. The figure shows how the disc-shaped hollow compartments are connected to the wall of the container in three different places in the embodiment shown in this drawing, two on each upper side and one centrally in the bottom of the container. The discs are not connected directly as the axis is not connected to the discs but merely has the function of rotating the scrapes. The figure shows that the scrapes in each space between two disc-shaped hollow compartments can be in a different position as compared to the scrapes in the next space between two disc-shaped hollow compartments. The figure also shows that the discs do not connect to the whole circumference of the cylindrical portion of the container, but connect to the inner surface of the container through connection members 9 in the disc-shaped hollow compartments with open spaces 12 between connection members where part of the material flows through In FIG. 3 an enlarged portion of FIG. 2A is shown. The drawing shows that the scrapes have 3 different scraping members, two (10*a* and 10*b*) to scrape the discs on each side as well as the end scrape member (10*c*) to scrape inner surface of the container. The scrapes are hollow between the different scraping members, i.e. there is a space 11 between the 3 different scraping members 10*a-c*. This means that the scrapes are actually stirring the organic material or whirling it in the space between two disc-shaped hollow compartments or over to the next space between two disc-shaped hollow compartments, but not moving the material constantly in circles around the axis. As can be seen in the figure the scrapes are not arranged in parallel on the axis, but have different position on the axis with respect to the discs. This means that while some scrapes may be scraping the lower part of the chamber and thereby scraping material off the discs and stirring the material, other scrapes may be rotating above the disc upper portion of the semi-cylindrical disc. This reduces the power needed to rotate the axis and thereby the scrapes.

As the discs do not connect to the whole circumference of the cylindrical portion of the container, a space 12 is formed between the disc-shaped hollow compartment 4 and the inner side of the container. In addition to that, the space above the discs allows the organic material to be transferred from one space to another from the in-feed end to the out-feed end of the container. The drawing further shows how the disc-shaped hollow compartments are placed into the container via slits 13. The connection member of the disc-shaped hollow compartment then slides down the slit and at the bottom of the slit is an opening to connect the disc to the jacket 5 to allow flow of heating media between the jacket and the discs.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 5" shall also cover exactly 5 or "substantially constant" shall also cover exactly constant).

It will be appreciated that variations to the foregoing embodiments of the invention can be made while still falling within the scope of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. An apparatus for heating or removing a water phase from organic material, the apparatus comprising:

a container, said container being substantially horizontal and where the lower portion of the container has a cylindrical shape, said container further comprising an inlet and an outlet, a plurality of semi-cylindrical disc-shaped hollow compartments parallel and interspace arranged in the container, a jacket arranged around the container for conducting heating media, an axis arranged centrally within the container, and scrapes attached to, and rotating on the centrally arranged axis, said scrapes being shaped to scrape an outer surface of two parallel and interspace arranged disc-shaped hollow compartments and extending towards and to scrape the inner surface of the container, wherein the semi-cylindrical disc-shaped hollow compartments comprise hollow protrusions which connect to the jacket through connection openings in the container, said protrusions being positioned on each side in the upper part and in the lowest part of the semi-cylindrical disc-shaped hollow compartments.

2. The apparatus according to claim 1, wherein the scrapes extend fully to the inner surface of the container.

3. The apparatus according to claim 1, wherein the arm of each scrape has a spring element.

4. The apparatus according to claim 1, wherein the scrapes have different scraping members, two disc scrape members to scrape the discs on each side and one end scrape member to scrape inner surface of the container.

5. The apparatus according to claim 4, wherein the scrapes have hollow space between the different scraping members.

6. The apparatus according to claim 1, wherein the scrapes are not arranged in parallel on the axis.

7. The apparatus according to claim 1, wherein the container is raised at the in-feed end above the out-feed end of the container.

8. The apparatus according to claim 1, wherein the inner surface of the container comprises vertical recesses leading to the connection openings in the side of the container.

9. The apparatus according to claim 1, wherein the blade of the scrapes is shaped to direct the organic material over to the next space between two parallel and interspace arranged disc-shaped hollow compartments, from the in-feed end and towards the out-feed end of the container.

10. The apparatus according to claim 1, wherein the heating media in the jacket is steam.

11. The apparatus according to claim 1, wherein the apparatus is a cooker or a dryer.

12. A method for assembling an apparatus for heating or removing a water phase from organic material comprising:

providing a container, said container being substantially horizontal and where the lower portion of the container has a cylindrical shape, said container further comprising an inlet and an outlet, arranging a plurality of disc-shaped hollow compartments parallel and interspaced in the container, arranging a jacket arranged around the container and connecting to the said disc-shaped hollow compartments to the jacked through openings in the container, arranging an axis centrally within the cylindrical container, and providing scrapes attached to, and rotating on the centrally arranged axis, said scrapes being shaped to scrape an outer surface of two parallel and interspace arranged disc-shaped hollow compartments and extending towards and to scrape the inner surface of the container, wherein, the semi-cylindrical disc-shaped hollow compartments comprise hollow protrusions which are connected to the jacket through connection openings in the container, said protrusions being positioned on each side in the upper part and in the lowest part of the semi-cylindrical disc-shaped hollow compartments.

13. The method according to claim 12, wherein each semi-cylindrical disc-shaped hollow compartments is attached to the openings in the container from the outside.

14. The method according to claim 12, wherein each semi-cylindrical disc-shaped hollow compartments is attached to the openings in the container by welding.

15. The method according to claim 12, wherein the jacked is arranged around the container after the semi-cylindrical disc-shaped hollow compartments have been attached to the container.

16. The method according to claim 12, wherein an opening at the top of the container is closed after the semi-cylindrical disc-shaped hollow compartments, the axis and the scrapes have been arranged within the container and the semi-cylindrical disc-shaped hollow compartments have been attached to the container.

* * * * *